US005226440A

United States Patent [19]

Fuhrman

[11] Patent Number: 5,226,440

[45] Date of Patent: Jul. 13, 1993

[54] TENT AND LIKE FRAME STRUCTURE WITH DOUBLE TUBE BEAM AND RAFTER COMPONENTS

[75] Inventor: Michael J. Fuhrman, Seattle, Wash.

[73] Assignee: Johnson Camping, Inc., Binghamton, N.Y.

[21] Appl. No.: 812,727

[22] Filed: Dec. 23, 1991

[51] Int. Cl.[5] ..... E04H 15/44

[52] U.S. Cl. ..... 135/106; 135/108; 52/730.1; 52/730.4; 52/731.2

[58] Field of Search ..... 135/106, 102, 109, 108, 135/107, 908, 909, 112; 52/730.1, 730.2, 730.4, 731.2, 732.1, 731.4, 731.5, 732.2, 63, 222, 82, 582, 584

[56] References Cited

U.S. PATENT DOCUMENTS

| | | | |
|---|---|---|---|
| 426,558 | 4/1890 | Dithridge . | |
| 1,958,296 | 5/1934 | Crow . | |
| 2,916,910 | 12/1959 | Boyer et al. | 52/730.2 X |
| 4,136,408 | 1/1979 | Dahlbeck et al. . | |
| 4,192,334 | 3/1980 | Daws | 135/102 |
| 4,219,036 | 8/1980 | Biggs | 135/109 X |
| 4,280,521 | 7/1981 | Zeigler | 135/106 X |
| 4,433,700 | 2/1984 | Dohet . | |
| 4,558,713 | 12/1985 | Hagler et al. | 135/109 X |
| 4,639,627 | 12/1986 | Windows et al. . | |
| 5,094,043 | 3/1992 | Ristow | 52/222 X |
| 5,115,828 | 5/1992 | Spaulding | 135/108 X |
| 5,167,246 | 12/1992 | Mortenson | 135/106 |
| 5,181,352 | 1/1993 | Friedman | 52/63 X |

*Primary Examiner*—Richard E. Chilcot, Jr.
*Assistant Examiner*—Lan M. Mai
*Attorney, Agent, or Firm*—Foley & Lardner

[57] ABSTRACT

Readily assemblable and disassemblable tent, awning and canopy frame structures incorporating conventional slip fit junction elements and beams and rafters of double tube form which enable greater spans between uprights and simplified structures for larger area tent or like frames, the configuration of the double tube beams and rafters being such that the double tube beam, rafter and upright components can be interchanged with single tube beams, rafters and uprights. The unique double tube forms are characterized by a cross-sectional configuration including two circular walls interjoined by two planar walls interconnected with the circular walls substantially at diametrically opposed circumferential locations in the circular walls and by increased strength-to-weight ratios.

12 Claims, 4 Drawing Sheets

20x20
20x20
10
12
14
16
18
20
22
30
32

20 X 20

20 X 40

20 X 60

40 X 40

40 X 60

40 X 100

40 X HEX

TENT AND LIKE FRAME STRUCTURE WITH DOUBLE TUBE BEAM AND RAFTER COMPONENTS

BACKGROUND OF THE INVENTION

1. Field of the Invention

The present invention relates to assemblable and disassemblable frame structures such as used for tents, awnings, canopies and the like, and more particularly relates to such structures which utilize conventional junction elements and compound tube beam and rafter components enabling relatively greater spans and relatively simpler construction than is possible with conventional single tube beam and rafter components.

2. Description of the Prior Art

Conventional tent, awning and canopy frame structures of a readily assemblable and disassemblable nature such as utilized in the rental trade are commonly made up of cylindrical tubing and various types of junction elements or connectors, or so-called slip fit or slip-on fittings, commonly termed corner, ridge intermediate, intermediate, three-way crown, four-way crown, six-way crown and eight-way crown fittings, fabricated of 1.66" OD aluminum or steel tubing. To assemble a given desired structure, it is conventional to use 2" OD cylindrical tubing with ⅛" inch wall thickness in appropriate lengths to make up the uprights (suitably in 7'8" lengths), eave beams (suitably in 9'4", 14'4" and 19'4" lengths) and hip rafters (suitably in 6'10", 10'6", 14'4", 21'10" and 29'4" lengths) and, where used, intermediate rafters (suitably 5', 10'6", 16'1" and 21'8" lengths) with the various rafters being interconnected by a crown fitting at the ridge or peak or peaks or by corner or intermediate fittings at the eave beams. Conventionally, also, the tubes and fittings are joined together in a telescoping manner with the tubes telescoped over associated arms of the fittings and the tubes and fittings are interlocked together by so-called locking quick pins. With such conventional single tube constructions, it is common to limit the span between uprights to ten feet, i.e. limit the length of the eave beams to 9'4" so that the structure had adequate strength to withstand unusual loads, windstorms or the like with an adequate safety margin. It is also known to use single tube eave beams of 14'4" length in certain light duty applications. However, when sturdy tent, awning or canopy structures are desired of relatively larger area coverage, the assemblage becomes quite complicated with need oftentimes for additional internally placed supporting components.

Crow U.S. Pat. No. 1,958,296 discloses tent frames providing an increased span between corner posts by use of arched braces, also called trusses, which in general are made up of laterly spaced top and bottom chords interconnected by spaced struts.

In general it is also known as in Dithridge U.S. Pat. No. 426,558 to construct "beams or sills for railway-cars" with tubular edges and with one or more connecting plates therebetween and with the one or more connecting plates arranged essentially coplanar with the axial centers of the tubular edges, but without any suggestion of utilization of any similar compound tubular configuration in readily assemblable and disassemblable structures such as the structures to which the present invention applies.

SUMMARY OF THE INVENTION

The principal feature and advantage of the present invention is the provision, in readily assembleable and disassemblable tent, awning and canopy structures, of double tubular rafters of unique cross section to double the span between upright posts and quadruple the area which the structure overlies, and to do so in a manner so that the double tube rafter components are usable with conventional interconnectors and are interchangeable with single cylindrical tubing components conventionally used, to the extent desired in any given structural configuration.

It is a further object and feature of the present invention to provide a double tube tent, awning or canopy frame beam and rafter configuration with a maximized strength-to-weight ratio and a like cross section end for end so as to be readily fabricated as by extrusion from high strength aluminum alloy or the like.

It is a further object and feature of the present invention to provide what has been heretofore a gap in the design of readilly assemblable and disassemblable tent frame structures, i.e. to provide what has been the missing structural component between typical small tent, awning or canopy frame components and the large building frame components using massive aluminum tubing of rectangular cross-section. Critical to the beam and rafter structure concept of the present invention is the feature of upward compatibility with all slip fit fittings for standard event tents. With the double tube beam and rafter constructions of the present invention it is possible to build a 40' frame tent structure using exactly the same fittings as are now used to build a 20' or a 30' frame. In addition, the assembly and disassembly times are markedly reduced, in some cases as much as 50%. With the double tube beam and rafter components provided by the present invention, it is possible to build a sturdy tent frame with 20', spacings between the legs or uprights. For example, one can build a 20' by 20' frame using only four corner fittings, four legs, four hip rafters, four eave beams, and one four-way crown fitting. Double tubing and conventional single tubing can be mixed and matched according to special event needs. For example, one can span one side of a 20' by 20' frame with only one twin tube beam, while using standard fittings and tubing on the other sides. When compared with standard 2" single tubing, the double tubing of the present invention provides up to six times the resistance to deflection.

These and other objects, features, advantages and applications of tent, awning and canopy structure and components thereof will be evident from the following description and accompanying illustrations.

DESCRIPTION OF THE PREFERRED EMBODIMENTS

Figures 1, 2:
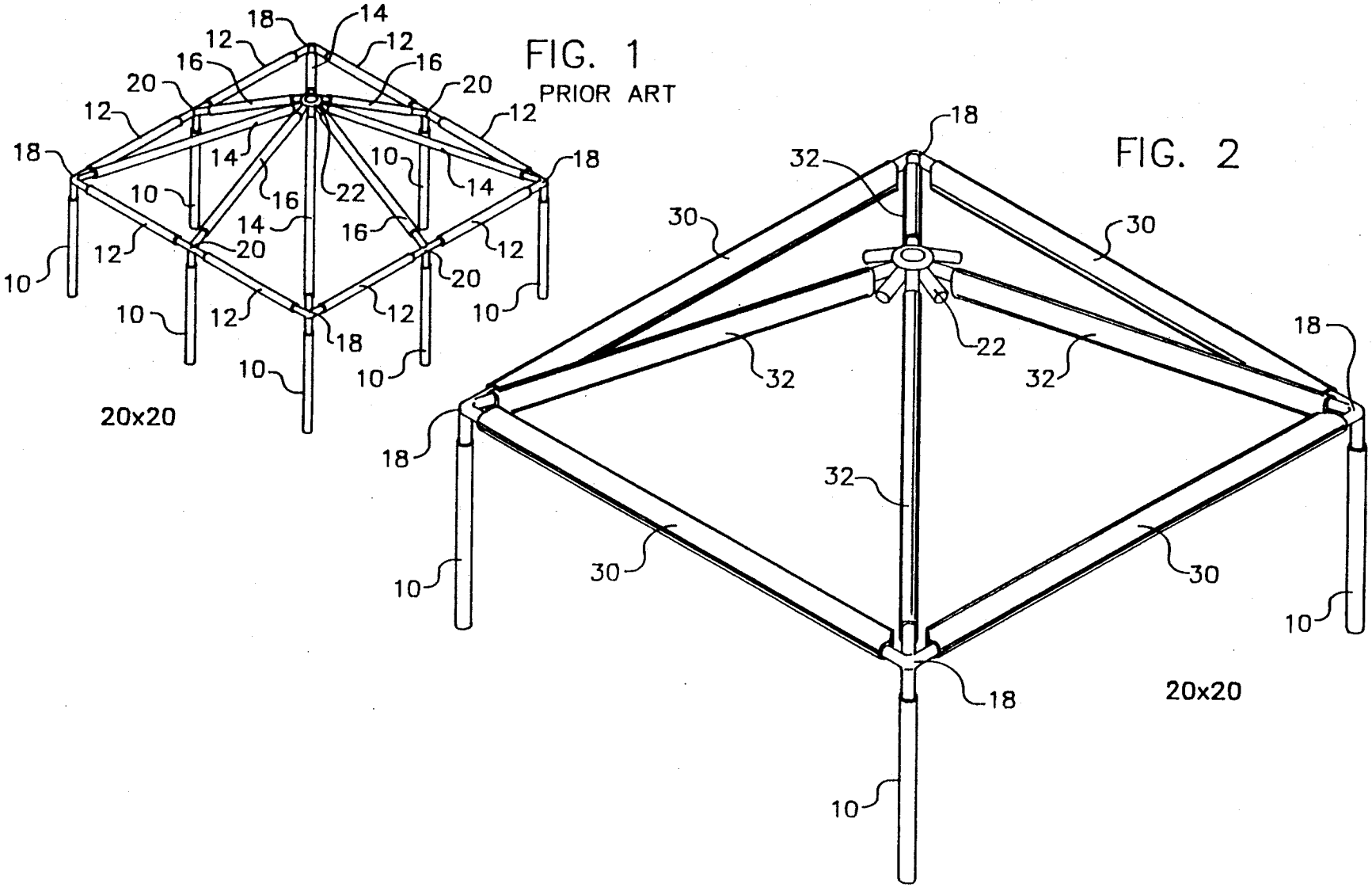
FIG. 1 PRIOR ART
FIG. 1 is an isometric view of a conventional tent frame constructed of single 2" tubing and associated connectors to provide a 20' by 20' (20×20) structure.
FIG. 2 is an isometric view on an enlarged scale of a 20' by 20' (20×20) tent frame utilizing double tube beams and rafters according to the present invention and standard connectors.

Referring specifically to the drawings, FIG. 1 illustrates in somewhat schematic form a conventional assembly for a 20' by 20' tent frame (20×20), comprising single tube uprights or posts 10, single tube eave beams 12, four hip rafters 14, and four intermediate rafters 16. In conventional style, corner fittings 18 interconnect the corner uprights 10, the adjacent eave beams 12 and hip rafters 14, intermediate connectors 20 interconnect adjacent uprights 10, eave beams 12 and intermediate rafters 16, and the various hip and intermediate rafters 14, 16 are interconnected at the peak by an eight-way crown fitting 22. Such construction provides a substantially 10' span between uprights around the periphery of the structure. As is also conventional, the single tube uprights and rafters are commonly 2" OD aluminum tubing with a ⅛th inch wall thickness and the various slip fit or slip-on fittings have arms with a 1.66" OD and are fabricated of steel or aluminum alloy.

FIG. 2 illustrates on an enlarged scale a 20' by 20' (20×20) tent frame assembly according to the present invention. In this instance, corner fittings 18 are of the same conventional form as utilized in the structure of FIG. 1, as are the single tube uprights or posts 10. According to the invention, double tube eave beams 30 extend between adjacent corner fittings 18 over substantially a 20' span (with 19'4" eave beams) and the corner fittings 18 interconnect the corner uprights 10 and the eave beams 30 and associated hip rafters 32, also of double tube configuration, with the hip rafters 32 in turn being interconnected by being telescoped over four of the arms of an eight-way crown fitting 22, it being apparent with respect to this latter fitting that a four-way crown fitting would serve as well in that four of the arms of the eight-way crown fitting are not used in the assembly of FIG. 2.

Figure 3:
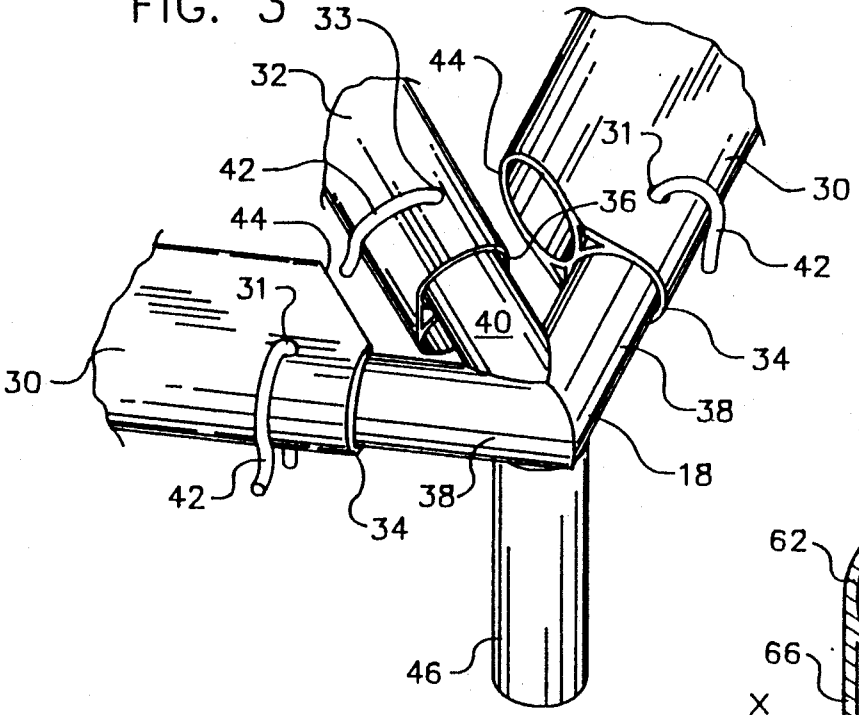
FIG. 3 is an enlarged detail view of one of the corner connectors and associated beams and rafter of the tent structure shown in FIG. 2.

FIG. 3 shows on a further enlarged scale one of the corner fittings 18 and portions of the associated double tube eave beams 30 and hip rafter 32 of the tent frame assembly shown in FIG. 2. In a manner conventional per se, the beams and rafter 30, 32 are assembled with one of the tubular portions at the respective ends 34, 36 thereof telescoped over respective arms 38, 40 of the fitting 18. In a manner also conventional per se, each of the arms 38, 40 and each of the beams and rafter 30, 32 is provided with a diametrically extending hole 31, 33, respectively, through which a conventional locking quick pin 42 is installed and is frictionally held in place by contact with the external surface of the beam or rafter. As will be understood, each beam and rafter 30, 32 is similarly interconnected with each corner fitting 18 in the tent frame assembly shown in FIG. 2, and a similar locked interconnection is provided between each of the hip rafters 32 and the associated arms of crown fitting 22 in the assembly of FIG. 2, although not there shown because of the smallness of this detail.

The detail showing in FIG. 3 also illustrates an optional aspect of the configuration of the eave beams 30, which are cut away at about a 45° angle in the end portion 44 thereof to accommodate closer assembly of the double tube form with respect to the associated hip rafter 32. Evident also in FIG. 3 is the arrangement of the downwardly depending arm 46 of the corner fitting 18 onto which the uprights or posts 10 are telescoped (as shown in FIG. 2).

In any tent frame structure such as shown in FIGS. 1 and 2, it is also conventional to stabilize the structure by cables or the like (not shown) extending outwardly from the corner fittings 18 to ground stakes or other anchors.

Figure 4:
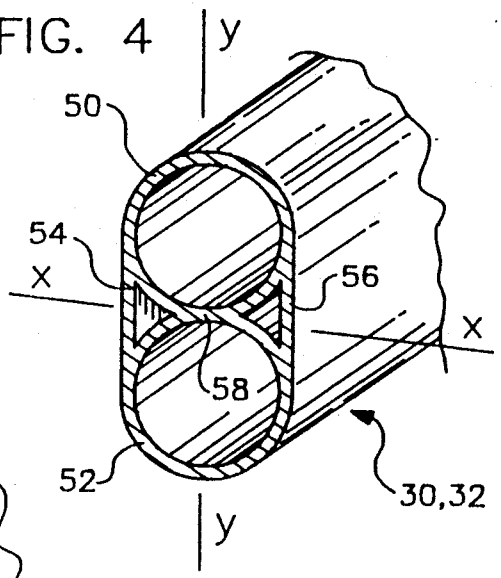
FIG. 4 is a further enlarged detail view of one of the double tube beams or rafter of the tent structure shown in FIGS. 2 and 3, showing a lateral cross section thereof.

FIG. 4 shows further detail in lateral cross-section of the double tube beams and rafters 30, 32. In this form of double tube beam or rafter the strength-to-weight ratio is optimized with a cross-sectional configuration including two circular walls 50, 52 interjoined by two planar walls 54, 56 interconnecting the circular wall substantially at diametrically opposed circumferential locations in the circular walls. In this form of rafter wherein the circular walls are 2" in outside diameter (OD) and the wall thickness throughout is ⅛", the two circular walls are joined at the circumferential location 58 therebetween and the form overall can be simply categorized as being of 2" by 4" (2×4) size (actually 2"×3⅞" by reason of the shared common circumferential wall portions).

Figure 5:
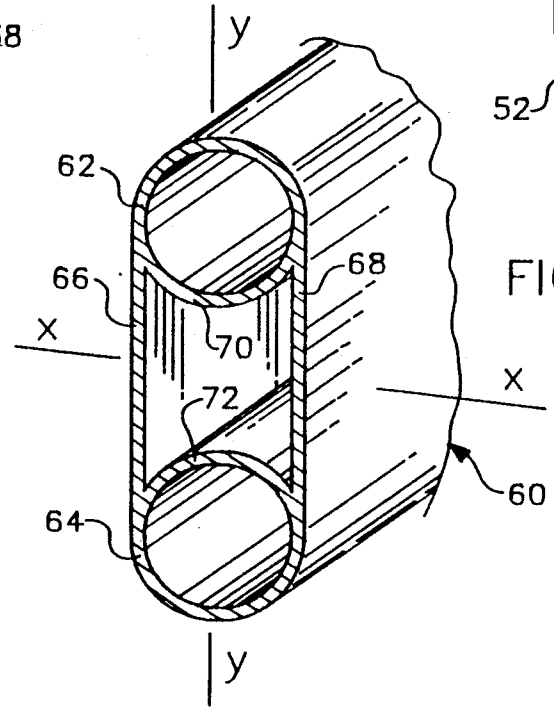
FIG. 5 is a view similar to that of FIG. 4 showing the lateral cross section of a modified form of double tubing beam or rafter according to the present invention wherein the cylindrical portions thereof are spaced laterally a distance approximately equal to a diameter of the tubular portions.

FIG. 5 illustrates an alternative form of beam or rafter 60 wherein the configuration cross-sectionally comprises two circular walls 62, 64 interjoined by two planar walls 66, 68 with the innerfacing portions 70, 72 of the circular walls spaced apart a distance about equal to the diameter of the circular walls. This beam or rafter configuration, wherein the circular walls 62, 64 have an outside diameter of 2", and the wall thicknesses throughout are ⅛", can be categorized as being substantially 2" thick and 6" wide, i.e. 2×6 in form. This form is actually 2"×5¾" in an optimal design so that there is a clearance dimension of 1¾" along both the x-x axis and the y-y axis of the tubing. This configuration allows use of the 2×6 type tubing as uprights with corner fittings like that shown in FIG. 3 which are modified to have a double depending arm in place of the single depending arm 46 to fit within the double tubes of the 2×4 form (FIG. 4) and also the 2×6 form dimensioned as described.

Figure 6:
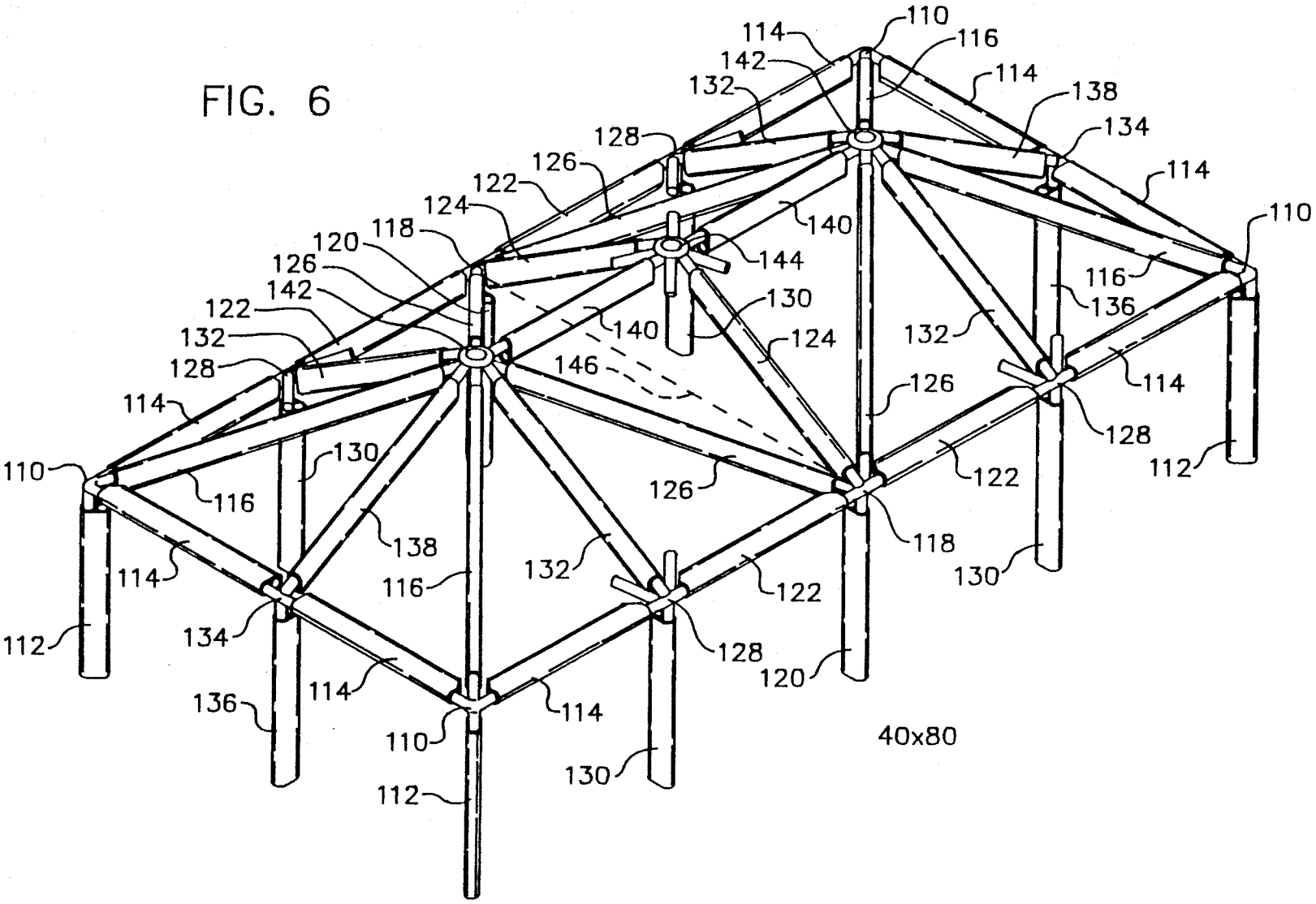
FIG. 6 is an isometric view on a reduced scale, as compared with FIG. 2, of a more complex tent structure assembly according to the present invention utilizing the double tubes of the present invention for the rafters, eaves and uprights along with conventional connectors, the configuration of the structure providing a coverage of substantially 40' by 80' (40×80).

FIG. 6 is a further illustration in isometric and somewhat schematic view of a more complex tent frame structure characteristic of the invention, utilizing double tube beams and rafters and, in this instance, double tube uprights or posts, the structure being designed to cover a ground or floor space approximately 40' by 80' (40×80). In this structure, conventional corner fittings 110 interjoin double tube corner posts 112, corner eave beams 114 and hip rafters 116. Intermediate six-way fittings 118 interjoin double tube posts 120, intermediate eave beams 122, center rafters 124 and diagonal 126. Like intermediate six-way fittings 128 (utilizing only four arms thereof) interjoin double tube posts 130, corner and intermediate eave beams 114, 122, and laterally intermediate rafters 132. Similarly, also, intermediate end end fittings 134 interjoin double tube posts 136, end eave beams 114 and longitudinal roof rafters 138. The various roof rafters 116, 126, 132, and 138 are joined along with double tube ridge beams 140 by eight-way crown fittings 142 and a center eight-way crown fitting 144, four arms of which are used, interconnects roof rafters 124 and ridge beams 140.

As an optional component, in some structures it may be considered desirable to increase the lateral support centrally of the frame, which can be done simply by cable interconnection between the center intermediate fittings 118, with such a cable connection being schematically indicated in FIG. 6 at 146. Comparable cable interconnections (not shown) may also interconnect intermediate fittings 128, if desired.

FIGS. 7A through 7G diagrammatically illustrate other typical tent frame structural arrangements possible with double tube rafters according to the present invention with 20' spans between uprights along the sides thereof.

Figure 7A:
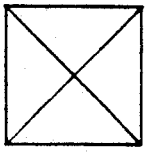
FIGS. 7A, 7B, 7C, 7D, 7E, 7F and 7G are diagrammatic showings of typical other structural arrangements of tent frames with double tube rafters according to the present invention.
Figure 7B:
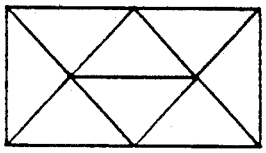
Figure 7C:
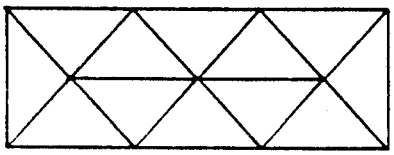

FIG. 7A is a concept diagram of a 20×20 frame structure, which is the structure illustrated and discussed with respect to FIG. 2. FIG. 7B shows the rafter arrangement for a typical 20' by 40' (20×40) tent structure according to the present invention, the FIG. 7C shows a 20' by 60' (20×60) version thereof.

Figure 7D:
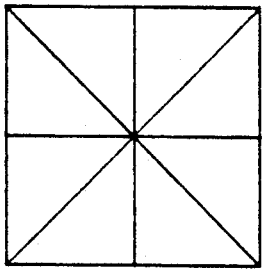
Figure 7E:
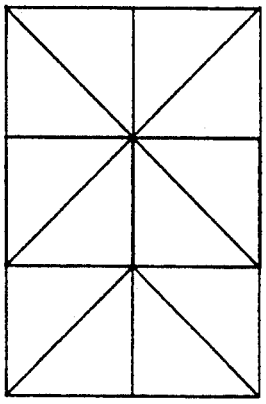
Figure 7F:
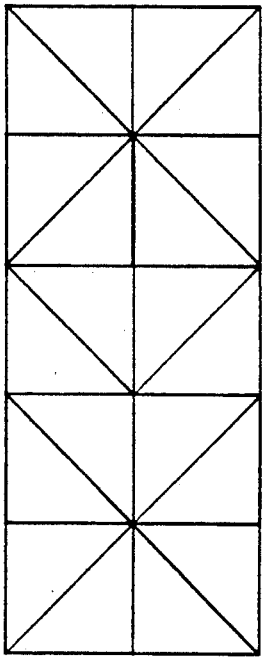

FIG. 7D, 7E and 7F respectively show diagrammatically the rafter plan for 40×40, 40×60 and 40×100 tent structures according the invention, all of which are similar in many respects to the 40×80 frame structure shown and discussed with respect to FIG. 6.

Figure 7G:
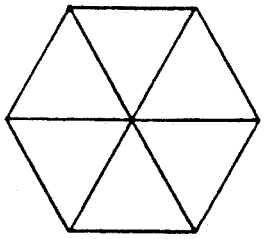

FIG. 7G is a further form of tent structure diagram according to the present invention, in this instance of hexagonal form with six sides (40x HEX) each approximately 20' in length with a single peak.

As an example of practice of the invention in the rental trade, it is common to color code various upright beams and rafters by color to denote application and length. Thus, an inventory of various styles, sizes and lengths can include, for both 2" single tubing and 2×4 double tubing, legs or uprights black in color and 7'8" in length, eave beams white in color and 9'4" in length, intermediate rafters green in color and 10'6" in length, hip rafters red in color and 14'4" in length, intermediate rafters brown in color and 16'1" in length (for 30' wide configurations), eave beams blue in color and 19'4" in length, hip rafters orange in color and either 21'8½" in length in the 2×4 form or 21'10" in length for the 2" tubing form, and 2×6 double tube eave beams 29'4" in length and color coded yellow which are used for example to bridge over a substantially 30' span at the front of an open stage type tent frame.

As earlier indicated, the double tube forms of beams and rafters typifying and contemplated by the present invention are characterized by a substantially increased strength-to-weight ratio as compared with the conventional single tube rafter construction. This can be demonstrated by a comparison of the moment of inertia of the respective tubular configurations. Addressing first the conventional single tube rafter which had an outside diameter of 2" and a ⅛" wall thickness, and which is fabricated of a suitable aluminum alloy such as alloy 6005T5, and utilizing standard formulations such as found in, "Machinery's Handbook", 12 Ed., published by The Industrial Press, NY, N.Y. (1944), at pages 298, 346 and 347, the moment of inertia of a conventional single tube is 0.324 $in^4$ along both its X axis and Y axis, and the weight thereof is 0.884 pounds per foot. The 2×4 (actually 2" by 3⅞") form of double tube as shown and discussed with respect to FIG. 4 has a moment of inertia of 1.92 $in^4$ along the X axis and 0.82 $in^4$ along the Y axis (with such axes being schematically shown in FIG. 4) and a weight per foot of 2.076 pounds. The 2×6 (actually 2" by 5¾") form of double tube as shown and discussed with respect to FIG. 5 demonstrates a moment of inertia of 7.1325 $in^4$ along the X axis and 1.31 $in^4$ along the Y axis (with such axes being shown schematically in FIG. 5) and a weight of 2.67 pounds per foot.

Correspondingly, consideration is to be accorded a form of double tube of the same alloy with two 2" OD cylinders of circular form in cross section and with ⅛" wall thicknesses, joined by a panel ¼" thick in planar form along the Y axis and coplanar with the centers of the tubular components, which double tube form is essentially the same as that illustrated in FIG. 1 of Dithridge U.S. Pat. No. 426,558. Such component tube configuration demonstrates a moment of inertia of 6.708 $in^4$ along the X axis, a moment of inertia of 0.65 $in^4$ along the Y axis, and a weight of 2.37 pounds per foot.

From these comparative figures, it is to be observed that the 2×4 tubing is stronger along its X axis than is the single tube by a factor of 5.93:1 while being heavier by a factor of 2.35:1. Comparing the 2×6 double tube with the 2" single tube, the 2×6 tube is stronger by a factor of 22.01:1 while exhibiting an increased weight by a factor of 3.25:1 along its X axis and an increased strength by a factor of 2.53:1 along its Y axis. Comparing the 2×6 form with the form of double tube referred to in the Dithridge patent, the 2×6 form exhibits a strength factor of 1.06:1 along its X axis and a strength factor of 2.02:1 along its Y axis while being slightly heavier by a factor of 1.13:1. It is notable with respect to the strength factor along the Y axis that such strength factor is significant in relatively long span beam applications so that any tendency of the beam to buckle is minimized.

As will be evident, further forms of double tubes characteristic of the present invention with planar walls joining circular sides at substantially diametrically opposed circumferential locations on the circular walls can be fabricated to provide rafters for use in tent frame construction according to the invention, such as forms similar to that shown in FIG. 5 with a lesser or greater lateral spacing between the cylindrical portions such as 2×5 and 2×8 forms, for example. Other assembly configurations than those shown in FIGS. 6 and 7A–7G will also readily occur to those skilled in the art to which the invention is addressed.

What is claimed is:

1. A readily assemblable and disassemblable tent, awning or canopy structure comprising tubular beams, tubular rafters, and tubular uprights interconnected by slip fit fittings in telescoped relation with respect to the beams, rafters and uprights, certain of said beams and rafters having a uniform cross-sectional configuration throughout, said cross-sectional configuration including two circular walls interjoined by two planar walls interconnecting the circular walls substantially at diametrically opposed circumferential locations in the circular walls.

2. The structure of claim 1, wherein the circular and planar walls are of substantially uniform thickness throughout.

3. The structure of claim 1, wherein the circular walls are about two inches in diameter and the wall thickness is about one-eighth inch.

4. The structure of claim 1, wherein the cross-sectional configuration of at least some of the beams and rafters is characterized by the two circular walls being joined at the circumferential location therebetween.

5. The structure of claim 1, wherein the cross-sectional configuration of at least some of the beams and rafters is characterized by the two circular walls at the interfacing portions thereof being spaced apart a distance at least equal to the diameter thereof.

6. The structure of claim 5, wherein the said wall interfacing portions are spaced apart about one circular wall diameter.

7. A double tube structure for use as a rafter, beam or upright in a tent or canopy frame assembly, said structure being of extruded metal having a uniform cross-sectional configuration throughout, including two circular walls interjoined by two planar walls interconnecting the circular walls substantially at diametrically opposed circumferential locations in the circular walls.

8. The structure of claim 7, wherein the circular and planar walls are of substantially uniform thickness throughout and the structure is formed aluminum alloy.

9. The structure of claim 8, wherein the circular walls are about two inches in diameter and the wall thickness is about one-eighth inch.

10. The structure of claim 9, wherein the said wall interfacing portions are spaced apart about one circular wall diameter.

11. The structure of claim 8, wherein the cross-sectional configuration is characterized by the two circular walls being joined at the circumferential location therebetween.

12. The structure of claim 8, wherein the cross-sectional configuration is characterized by the two circular walls at the interfacing portions thereof being spaced apart a distance at least equal to the diameter thereof.

* * * * *